US007017644B1

(12) United States Patent
Kraeutler

(10) Patent No.: US 7,017,644 B1
(45) Date of Patent: Mar. 28, 2006

(54) MULTIPURPOSE CONNECTION CONSOLE FOR MATERIAL HANDLING GATE

(75) Inventor: Bernard Kraeutler, Dunieres (FR)

(73) Assignee: Nergeco, Dunieres (FR)

( * ) Notice: Subject to any disclaimer, the term of this patent is extended or adjusted under 35 U.S.C. 154(b) by 612 days.

(21) Appl. No.: 09/720,082

(22) PCT Filed: Jun. 22, 1999

(86) PCT No.: PCT/FR99/01486

§ 371 (c)(1),
(2), (4) Date: Apr. 18, 2001

(87) PCT Pub. No.: WO99/67497

PCT Pub. Date: Dec. 29, 1999

(30) Foreign Application Priority Data

Jun. 23, 1998 (FR) ..... 98 07890

(51) Int. Cl.
*E06B 9/17* (2006.01)

(52) U.S. Cl. ..... 160/271; 160/903

(58) Field of Classification Search ..... 160/271, 160/310, 903, 133
See application file for complete search history.

(56) References Cited

U.S. PATENT DOCUMENTS

| | | | | |
|---|---|---|---|---|
| 4,234,032 | A | 11/1980 | Stark | |
| 4,583,706 | A * | 4/1986 | Whitehouse et al. | 160/133 X |
| 4,644,813 | A * | 2/1987 | Whitehouse et al. | 160/310 |
| 4,782,887 | A * | 11/1988 | Jones et al. | 160/310 |
| 4,844,140 | A * | 7/1989 | Jones et al. | 160/310 |
| 5,655,586 | A * | 8/1997 | Cattaneo | 160/903 X |
| 5,655,587 | A * | 8/1997 | Kraler | 160/903 X |

FOREIGN PATENT DOCUMENTS

| | | |
|---|---|---|
| DE | 38 11 901 | 1/1990 |
| EP | 586 271 | 3/1994 |
| EP | 476 788 | 4/1997 |
| EP | 717 807 | 12/1997 |
| GB | 1 487 329 | 9/1977 |

* cited by examiner

*Primary Examiner*—David Purol
(74) *Attorney, Agent, or Firm*—Sughrue Mion, PLLC

(57) ABSTRACT

In a goods-handling door, there is a bracket on either side of its top portion. The brackets serve to support the shaft for rolling up the door. The invention relates to a one-piece (molded) bracket offering various functions: guiding the curtain, fixing various accessories, thereby ensuring structural precision and easy maintenance.

11 Claims, 3 Drawing Sheets

MULTIPURPOSE CONNECTION CONSOLE FOR MATERIAL HANDLING GATE

BACKGROUND OF THE INVENTION

The invention relates to goods-handling doors.

The term "goods-handling doors" is used to designate doors installed in warehouses, factories, stores, sheds, etc. to make communication possible between different volumes or with the outside, and to provide temperature and noise insulation between said volumes or relative to the outside. Such a door makes it possible to close and to open an opening formed in a wall, and it must be capable of being opened and closed rapidly in order to limit the time during which the insulation is no longer provided. It is common for the door to include a panel mounted to move up and down between two uprights. It is also common for the door to be provided with a curtain that can be rolled or folded up at the top of the opening or on either one of the sides of the opening, the curtain generally being a flexible sheet or being made up of hinged panels. A rotary shaft is disposed, for example above the opening, to roll up the curtain, or else straps are provided to raise the curtain. The curtain is generally reinforced by at least one rigid bar whose ends slide with the edges of the curtain in vertical (or optionally horizontal) slideways.

One type of goods-handling door includes two brackets disposed on either side of the door at the top thereof.

An example of such a door is described in EP-0 717 807. That example is shown in accompanying FIG. 1, and it is described below with reference thereto. An opening 2 is formed in a wall 1. The door includes a flexible curtain 3 that can be rolled up around a shaft 4 disposed above the opening. Respective brackets are fixed on either side of the top of the opening. In that example, each bracket 10 is L-shaped (10G on the left and 10D on the right), comprising a first branch fixed against the wall and a second branch perpendicular to the first branch. The second branch 102G of the left-hand bracket 10G carries a first seat 103 for a bearing, and the second branch 102D of the right-hand bracket 10D carries a second seat for a bearing. The shaft 4 is carried by the two seats. The left-hand bracket carries a seat only, whereas the other bracket also carries all of the electrical control and mechanical drive members for the shaft: an electric motor 104, generally with incorporated brake and gearing, an end-of-stroke stop 105, and various relays and other electrical members 106. The curtain shown can be rolled up directly onto the shaft 4.

In that type of door, the brackets serve to fix the door assembly. They are fixed to the wall on the top edges of the opening. Those brackets are usually made of folded sheet metal and by welding. The accuracy of the parts manufactured in that way is limited. When assembling the door, it is often necessary to make adjustments and to re-drill holes, etc. Slideways 5 are disposed on the sides of the opening for receiving and guiding the edges of the curtain while it is moving up and down, and for holding it against the pressure of the wind or of draughts when it is lowered. In Patent EP-0 717 807, the slideways are fixed at their tops to the brackets, and at their bottoms to the floor. Certain other members can be fixed to the brackets by welding or by means of screws and bolts. Such members can serve to carry bearings (e.g. ball or roller bearings), for receiving a motor or a rolling-up shaft. It is possible to fix retention elements to prevent a shaft from falling if one end of it is broken accidentally. Such a retention member is described in Patent EP-0 586 271. Elements also exist that serve to re-insert the edges of the curtain into the slideways if ever they come out therefrom. Those elements can be fixed to the brackets or to side uprights of the door that contain or that constitute the slideways (see Patent EP-0 476 788). Elements also exist that are fixed to the top of the door and that serve to re-center the curtain at the start of lowering so as to ensure that the edges of the curtain are placed properly in the slideways.

SUMMARY OF THE INVENTION

Other elements can be fixed to the brackets to provide links to a motor unit, to side uprights or to slideways, etc.

An object of the present invention is to provide a multifunction bracket that is simpler, faster, more accurate, and less expensive to make.

According to the invention, a bracket is characterized in that, in one-piece, it offers the following functions:

fixing to a wall;

supporting a bearing for a rotary shaft; and fixing to a slideway.

According to another characteristic of the invention, the bracket is characterized in that, in one piece, it further offers the following functions:

protection against a shaft falling;

protection against a fallen shaft rotating;

curtain re-centering;

curtain edge re-insertion;

support for accessories; and fixing of covering.

Another object of the present invention is to provide a method of manufacturing a bracket such as above, the method being characterized in that said bracket is obtained in a single operation selected from molding, rotational molding, compression, injection molding, casting, thermoforming, stamping, forging, or machining.

In one application, an object of the invention is to provide a method characterized in that said bracket is obtained by assembling together at least two pieces, at least one of which is obtained in a single operation selected from molding, rotational molding, compression, injection molding, casting, thermoforming, stamping, forging, or machining.

The bracket may be made of a non-metallic material, of a light metal, or of a light alloy.

The invention also provides a goods-handling door including at least one such bracket.

BRIEF DESCRIPTION OF THE DRAWINGS

Other characteristics and advantages of the invention appear from the following description given by way of non-limiting example and with reference to the accompanying drawings, and makes it possible to understand well how the invention may be implemented.

In the drawings.

DETAILED DESCRIPTION OF PREFERRED EMBODIMENTS OF THE INVENTION

Figure 1:
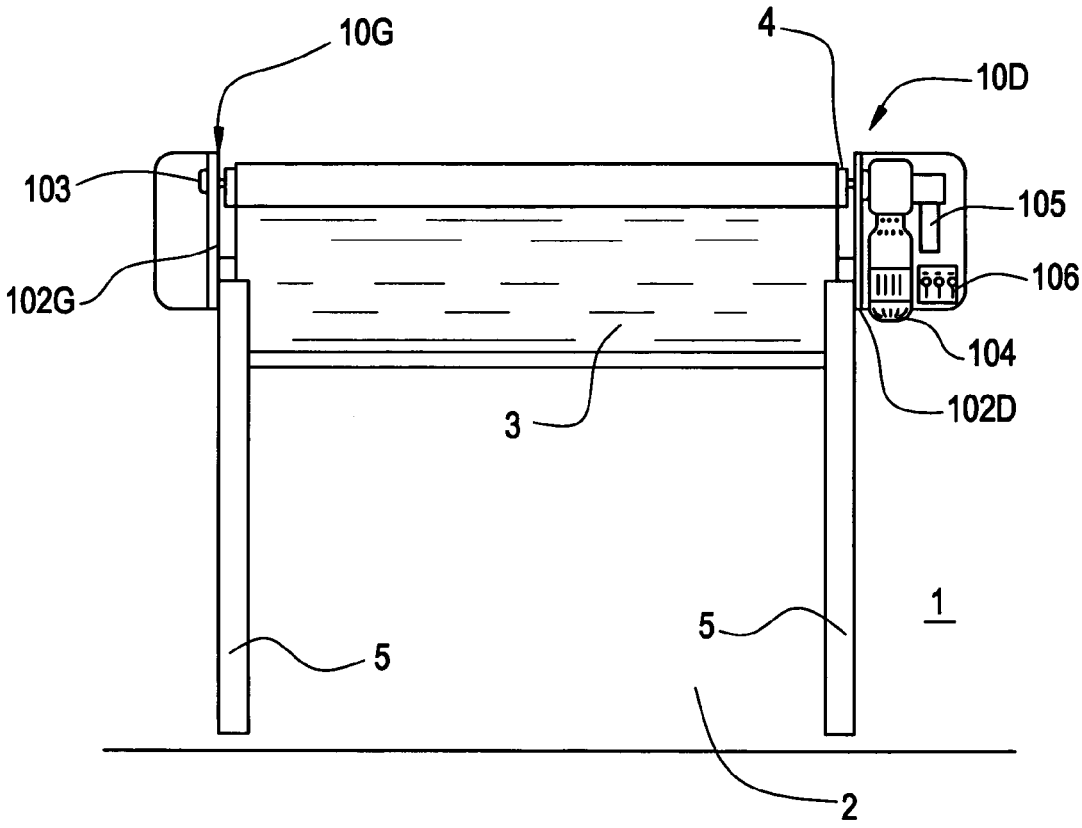
FIG. 1 is a front view of a goods-handling door including conventional-type brackets on either side.

The bracket 10 comprises a radial branch 12 that is perpendicular to the fixing wall, and a face branch 13 to be applied against the wall and fixable to the wall by bolts passing through two holes 31 and 32.

This bracket is remarkable in that it is multi-function. Thus, it can be provided with all or some of the following elements.

The radial branch is edged by two strips 21, 22 thus forming two L-shaped rims so that, on the side facing towards the door, it is possible to fix a cover that covers the rolling-up shaft, and, on the side facing away from the door, it is possible to fix a cover that covers the motor unit, at least on one side of the door, it being possible for the other side to receive an electrical installation.

The radial branch may advantageously be provided with a slot 23 making it possible to install a rolling-up shaft. The end-wall of the slot is provided with reinforcement 24 forming a seat for receiving a ball or roller bearing together with the rolling-up shaft.

Under the seat, a device 25 for preventing the shaft from falling may be provided, e.g. of the type described in Patent EP-0 586 271, which may also be provided with a catch for preventing a broken-shaft from rotating.

In an advantageous embodiment, the bracket is molded with a tab 26 for fixing to a slideway or to an upright by means of two holes 26A, 26B. In the drawings, this tab has its plane parallel to the face plane that is applied against the wall. This configuration is not limiting.

The slideway is not shown and is independent from the present invention. It may have be of any shape and section. It generally has two surfaces parallel to the wall, represented by the lines 27 and 28 in FIG. 1, disposed on either side of the rolling-up axis, and more precisely on either side of the bottom edge of the curtain when said curtain is fully raised. After the curtain has been fully raised, and in order to force it to re-engage in the slideway on being lowered, two projections 44 and 45 are provided in register with the walls of the slideway. On being lowered from its top position, the curtain is forced to engage between said projections whose top surfaces form a flare, and it is lowered properly between the slideways. The bracket may also be provided with re-insertion guides 46, 47 projecting on either side of the plane of the curtain, beyond the outer wall of each slideway, as described in particular in Patent EP-0 476 788. FIG. 1 shows the position of the guide 47 relative to the tab 26 which is in register with the outside of the slideway on the side furthest from the wall.

For the purpose of fixing the motor means, inserts may be provided during molding, thereby simplifying installation of the motor means.

When the bracket is used for fold-up or concertina type doors, it is also possible, during molding of the bracket, to provide supports for receiving a tube for suspending the curtain.

Figure 3:
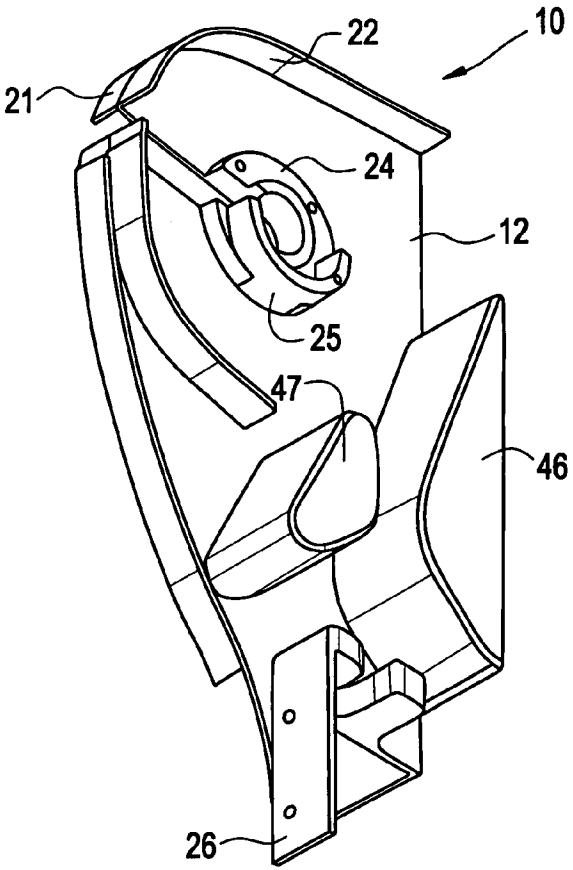
FIG. 3 is a view of the same device as FIG. 1, also showing the door side of the bracket, and further showing its face that faces away from the fixing wall.
Figure 2:
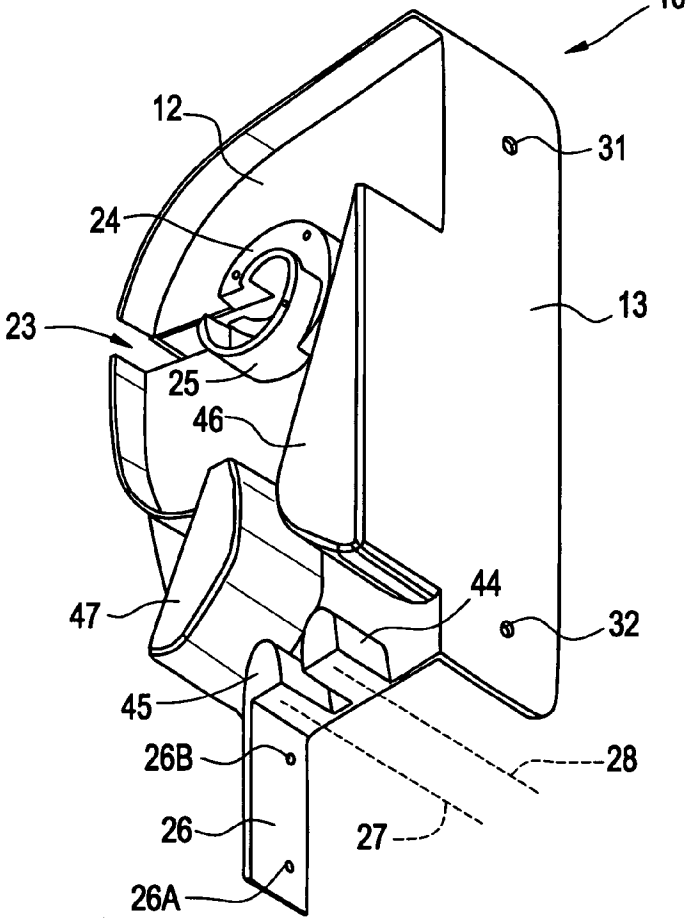
FIG. 2 is a perspective view of an embodiment of a fixing bracket device of the invention for a goods-handling door, as seen looking away from the door and showing both the door side of the bracket and its face for fixing to the wall.
Figure 5:
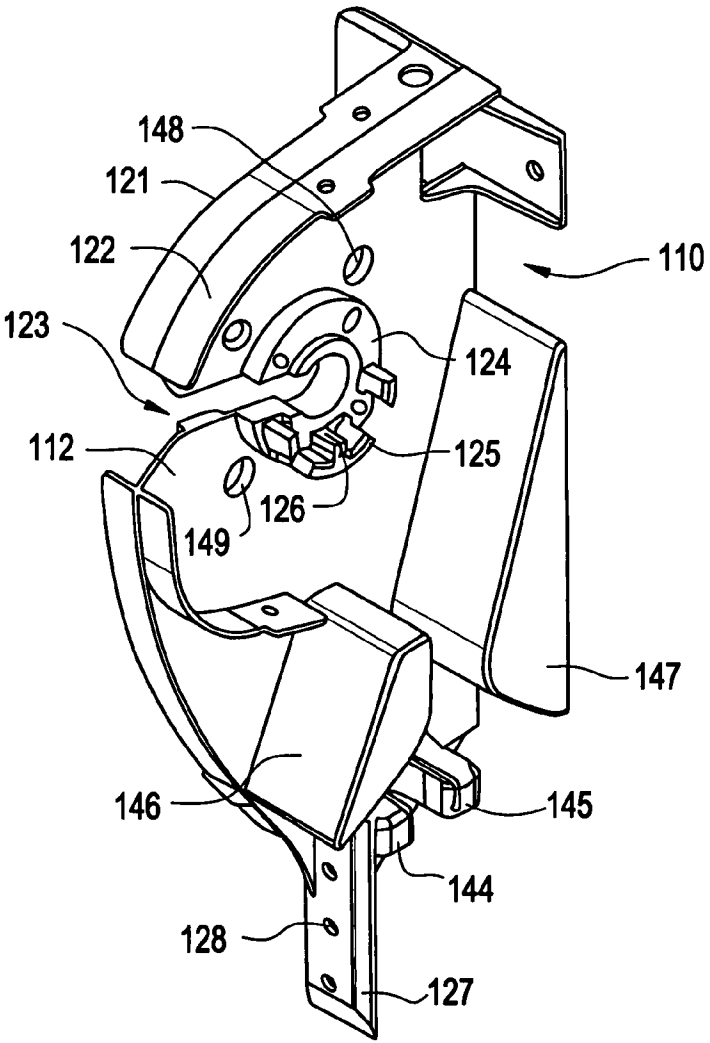
FIGS. 4 and 5 are views analogous to FIGS. 2 and 3, showing another embodiment of a bracket of the invention.
Figure 4:
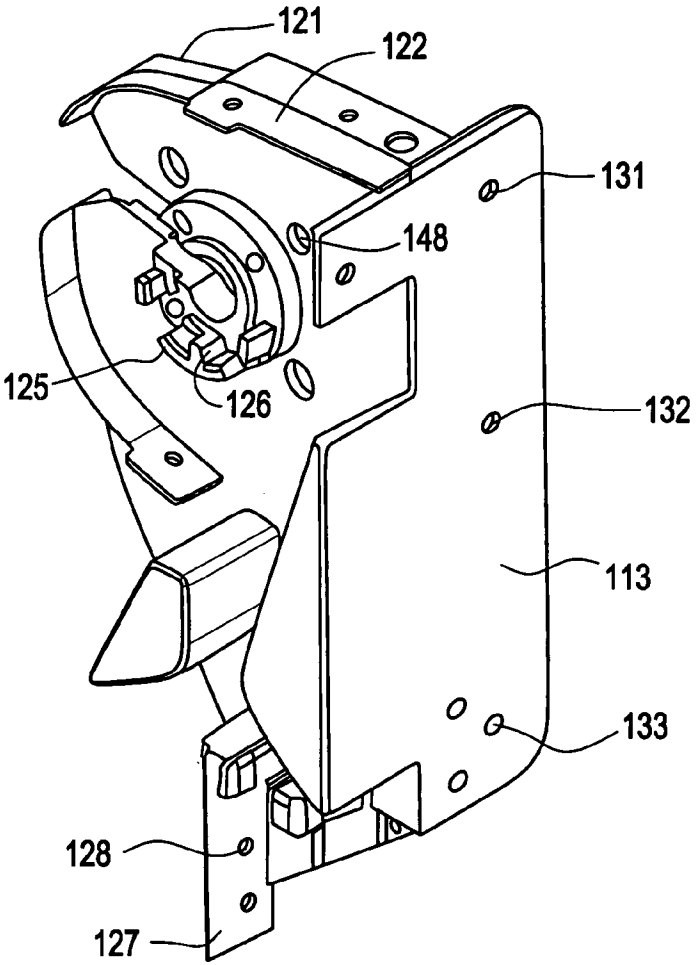

FIGS. 4 and 5 are views analogous to FIGS. 2 and 3, showing a similar bracket, seen from a higher observation point, thereby enabling certain details to be seen more clearly.

The bracket 110 also comprises a radial branch 112 that is perpendicular to the fixing wall and a face branch 113 organized to be applied against the wall, and fixable to the wall by bolts passing through suitable holes 131, 132, 133. The bracket 110 is also provided with means for fixing to covering: a strip 122 for fixing a cover on the side of the bracket that faces towards the door, so as to cover the rolling-up shaft, and a strip 121 for fixing a cover on the side facing away from the door, for covering and protecting the motor and other accessories. It is possible for such an outer strip to be omitted from the opposite bracket on the same door, if that bracket does not carry any outer accessories. The radial branch is also provided with a slot 123 for receiving the winding-up shaft, which has a bearing that is received in the circular reinforcement 124 that forms a seat. Under the seat, a retention support 125 is provided for receiving the rolling-up shaft if that end of the shaft which is situated in the ball or roller bearing breaks accidentally. A catch 126 prevents the curtain from falling by preventing the shaft from rotating by co-operating with a similar or equivalent catch provided in the vicinity of the end of the shaft, as already described and explained in Patent EP-0 586 271.

The bracket 110 is also provided with slideway fixing means constituted, in this example, by a tab 127 provided with holes 128 through which bolts can pass.

The centering projections 144 and 145 disposed on either side of the vertical plane containing the bottom edge of the curtain when said curtain is raised can be recognized in FIGS. 4 and 5, said bottom edge being at a level higher than the level of the projections. This is described and explained in Patent EP-0 476 788 (claim 9). It is also possible to see the re-insertion guides 146 and 147 whose function is described and explained in that patent.

Other functions may be provided, in particular supports for accessories, such as a pulley for a counterweight strap, a support for a curtain-hanging bar, etc. These functions may be constituted by pieces in relief or by holes disposed at appropriate places, making it possible to use bolts to fix holders or other supports equipped with the desired accessories.

The bracket of the invention is advantageously prefabricated completely in a single operation: it may be molded in any suitable material: metal, e.g. aluminum, plastic, or composite, or else it may be made by stamping. While being very advantageous, these methods are not limiting. In any event, it is very advantageous to be able to deliver a bracket that includes all its functions to the assembly site. Manufacturing by molding guarantees that design dimensions are satisfied accurately, and that overall manufacturing and installation costs are low. It is possible to choose the functions used for a particular type of door. Thus, in practice a single multi-function part made of at least one molded material is used for installing the door. Advantageously, the materials are chosen to be light and non-corrodable. Paint is avoided both during manufacture and during maintenance. The part can be stored easily, and delivered to satisfy demand rapidly. The advantages, in particular the cost advantages, are considerable.

What is claimed is:

1. A unitary multi-function bracket for a goods-handling door, said bracket comprising:

a face branch for fixing the bracket to a wall, wherein said face branch includes at least one hole therethrough;

means for supporting a bearing of a rotary shaft; and a tab for fixing the bracket to a slideway, wherein said tab includes at least one hole therethrough.

2. A method of manufacturing a bracket, wherein said bracket comprises the structure according to claim 1, the method comprising forming said bracket in a single operation, wherein said single operation is selected from molding, rotational molding, compression, injection molding, casting, thermoforming, stamping, forging, or machining.

3. A method of manufacturing a bracket, wherein said bracket comprises the structure according to claim 1, the method comprising forming the bracket by assembling together at least two pieces, wherein at least one of said pieces is obtained in a single forming operation selected from molding, rotational molding, compression, injection molding, casting, thermoforming, stamping, forging or machining.

4. A bracket according to claim 1, wherein said bracket is made essentially of a non-metallic material.

5. A bracket according to claim 1, wherein said bracket is made of a light metal or alloy.

6. A goods-handling door, said goods handling door comprising at least one bracket according to claim 1.

7. The unitary bracket according to claim 1, further comprising a retention support.

8. The unitary bracket according to claim 1, further comprising a catch adjacent to said retention support.

9. The unitary bracket according to claim 1, further comprising re-centering projections for guiding a curtain.

10. The unitary bracket according to claim 1, further comprising re-insertion guides.

11. The unitary bracket according to claim 1, further comprising at least one strip, extending from said face branch, for mounting a covering.

* * * * *